United States Patent [19]

Carter et al.

[11] Patent Number: 4,717,075

[45] Date of Patent: Jan. 5, 1988

[54] PARTICULATE DISPERSION APPARATUS

[75] Inventors: Anthony F. Carter, Newton Highlands; Calvin Rushforth, Andover; Walter L. Brassert, Belmont; Arnold M. Heitmann, Swampscott, all of Mass.

[73] Assignee: Northern Research & Engineering Corp., Woburn, Mass.

[21] Appl. No.: 886,908

[22] Filed: Jul. 18, 1986

[51] Int. Cl.[4] ..... B05B 7/14

[52] U.S. Cl. ..... 239/398; 239/553.5; 239/557

[58] Field of Search ..... 239/418, 424, 424.5, 239/557, 558, 422, 423, 428–430, 419, 596, 450, 553.3, 553.5, 398; 406/153, 194

[56] References Cited

U.S. PATENT DOCUMENTS

| | | | |
|---|---|---|---|
| 1,239,075 | 9/1917 | Bagnall et al. | 239/549 X |
| 1,892,920 | 1/1933 | Weiss | 406/194 |
| 1,945,298 | 1/1934 | Schmidt | 239/549 X |
| 3,100,724 | 8/1963 | Rocheville | 239/424 X |
| 3,204,682 | 9/1965 | Teleshefsky et al. | 239/549 |
| 3,565,346 | 2/1971 | Carrell | 239/422 |
| 4,356,970 | 11/1982 | Vosper et al. | 239/424.5 X |

FOREIGN PATENT DOCUMENTS

| | | | |
|---|---|---|---|
| 1047273 | 12/1953 | France | 239/427.5 |

*Primary Examiner*—Andres Kashnikow
*Attorney, Agent, or Firm*—B. J. Murphy

[57] ABSTRACT

A depicted embodiment of the apparatus comprises a housing having a chamber therewithin and a pair of ports opening into the chamber. One port admits an energized gas, and the other admits a particulate powder, into the chamber. Tubes conduct the powder through the chamber, isolated from the energized gas, to exit ends of the tubes which have convergent/divergent ejector nozzles circumjacent thereto. The ejector nozzles discharge the gas therethrough in fine streams, to draw powder from the tube exit ends for conveyance with the gas streams, and direct the streams of gas and powder to adjacent and collinear diffusers for dispersion of the gas-borne powder from the apparatus.

9 Claims, 10 Drawing Figures

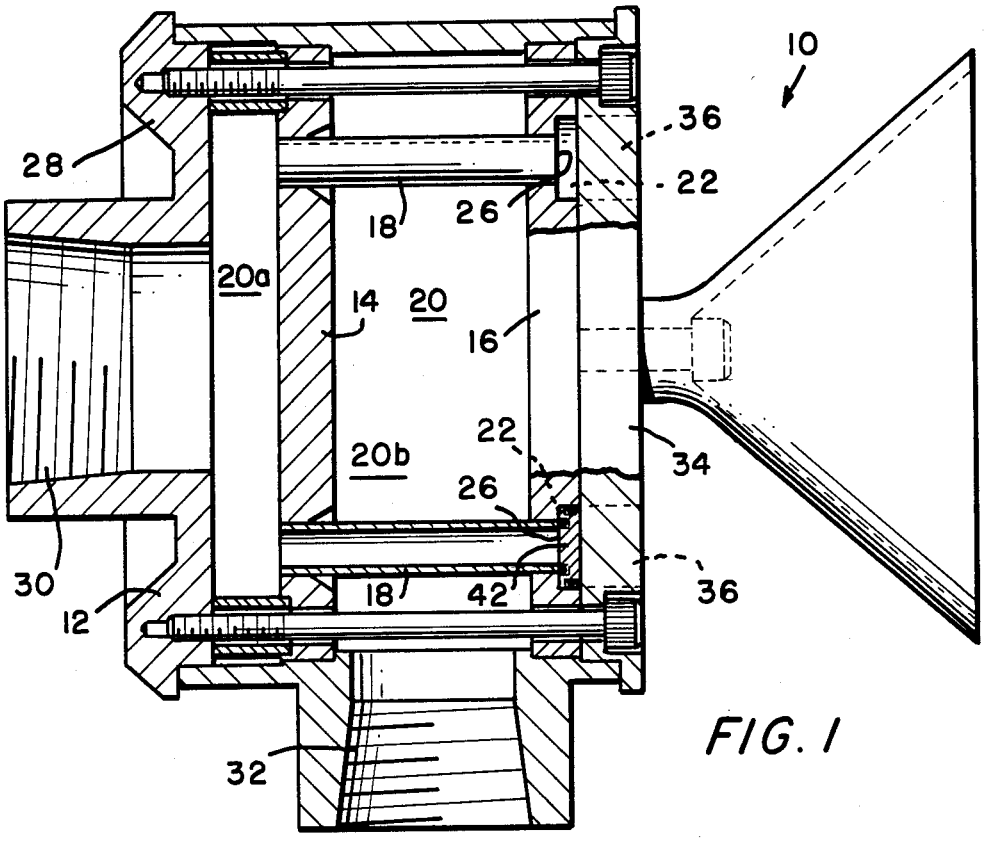
FIG. 1
FIG. 8
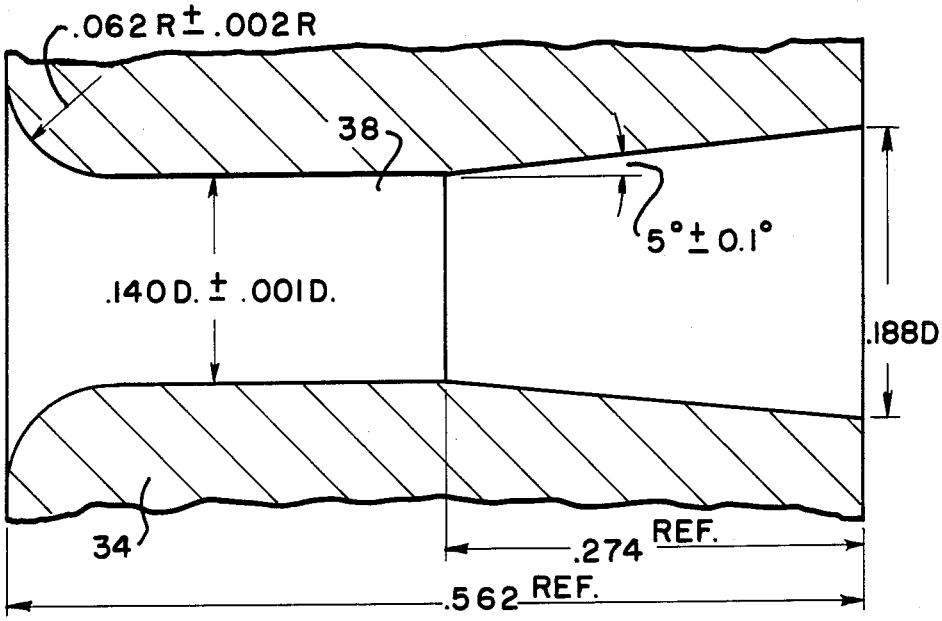

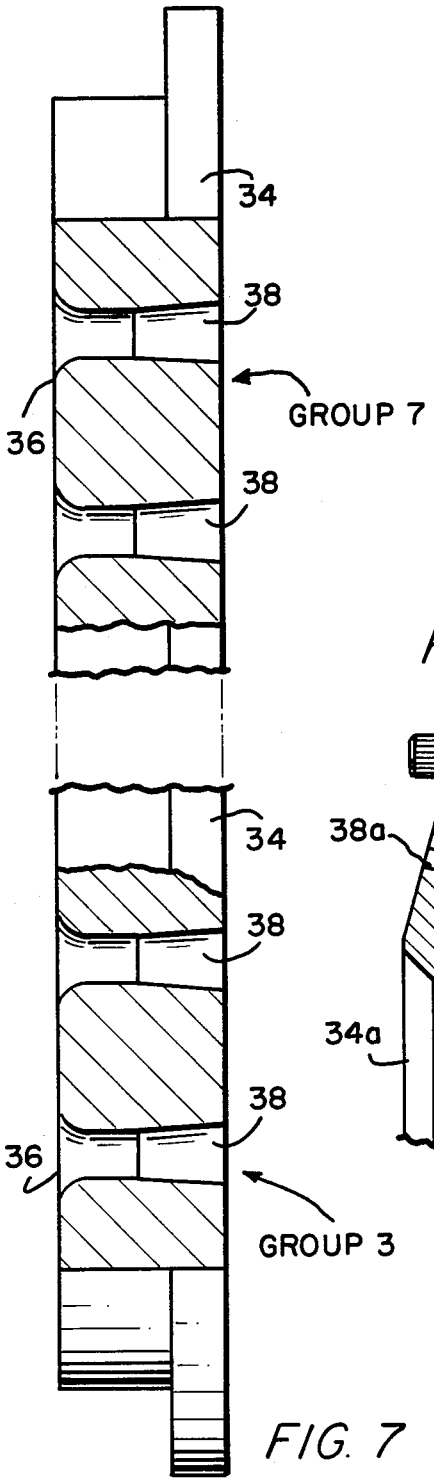
FIG. 7
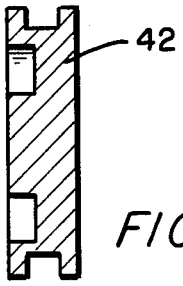
FIG. 9
FIG. 10
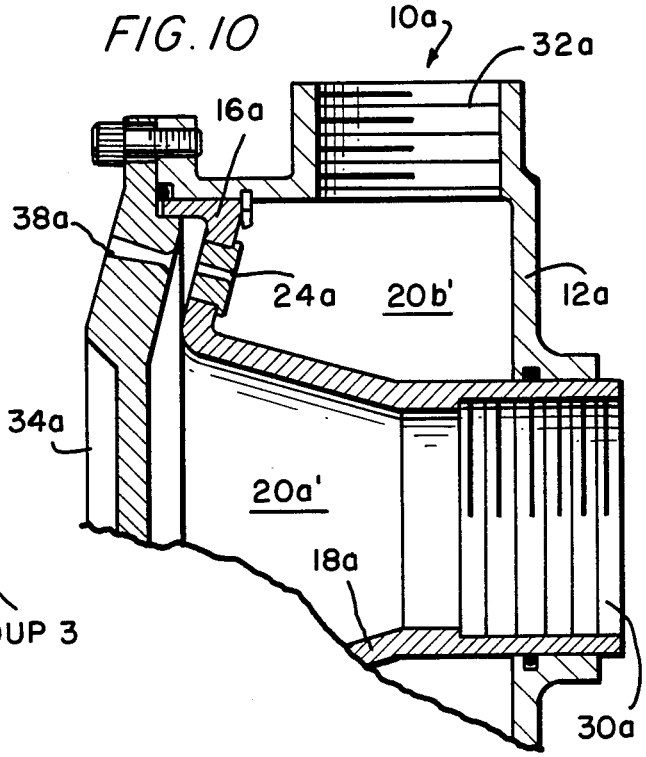

PARTICULATE DISPERSION APPARATUS

This invention pertains to particulate dispersion apparatus, and in particular to such an apparatus which will deliver particles from a powder to a natural airstream at a minimum size so that the particles will become airborne, and define a particle screen, without premature fallout of agglomerated particles near the apparatus discharge point. The purpose of such a particle screen is to obscure military equipment from unfriendly radar or infrared sensors. An efficient dispersion apparatus will obtain a minimum particle size so that the powder particulate will waft over large areas and remain airborne for a maximum period of time.

It is an object of this invention to set forth an especially efficient, particulate dispersion apparatus, of novel design, which will realize the aforesaid performance.

Particularly it is an object of this invention to disclose a particulate dispersion apparatus, comprising a housing; means for admitting both an energized gas, and particulate, into said housing; means for discharging such housing-admitted gas, and dispersing such housing-admitted particulate, from said housing; wherein said gas discharging and particulate dispersing means comprises an array of ejector nozzles and an array of diffuser nozzles; wherein said ejector nozzles of said array thereof are each collinearly aligned with one of said diffuser nozzles of said array thereof; and said ejector nozzles are of converging/diverging configuration.

Further objects of this invention, as well as the novel features thereof, will become more apparent by reference to the following description taken in conjunction with the accompanying figures, in which:

FIG. 1 is a cross-sectional view of a first embodiment of the apparatus, according to the invention, taken along section 1—1 of FIG. 2;

FIG. 7 is a cross-sectional view taken along section 7—7 of FIG. 6;

FIG. 8 is an enlarged, detail view of the circled detail in FIG. 7;

FIG. 9 is a view of a nozzle plug; and

FIG. 10 is a partial, cross-sectional view, generally corresponding to FIG. 1, of an alternate embodiment of the invention.

Figure 2:
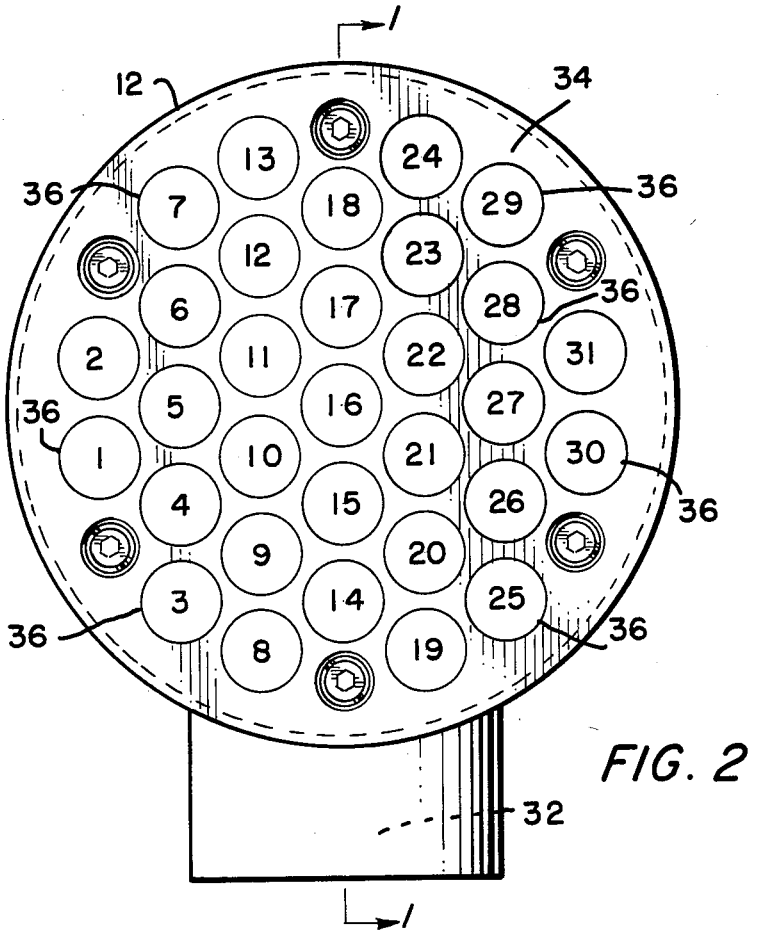
FIG. 2 is an elevational view of the FIG. 1 apparatus, taken from the right-hand side of FIG. 1, in which, however, the dispersion cone is omitted.
Figure 5:
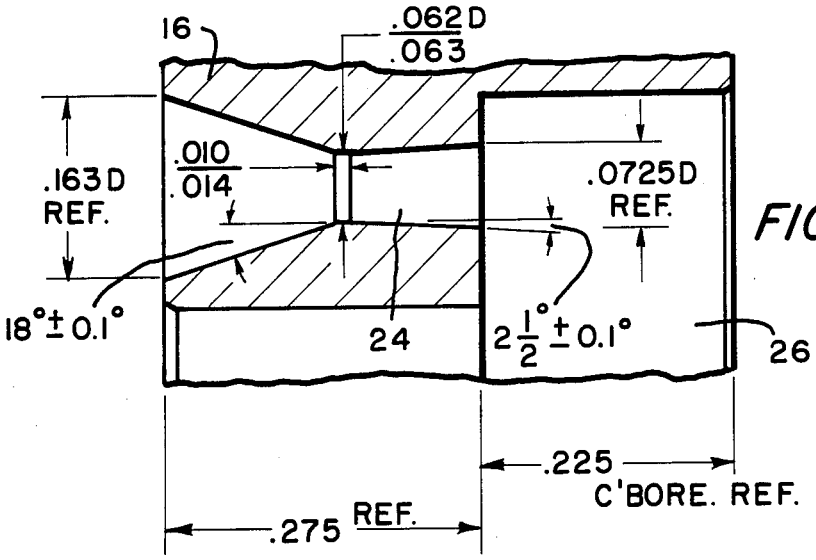
FIG. 5 is an enlarged, detail view of the circled detail in FIG. 4.

As shown in the figures, the novel apparatus 10 comprises a housing 12 in which are confined two support plates 14 and 16. These plates support thirty-one particle-carrying suction tubes 18 (only two being shown, however) which traverse a chamber 20 formed in the housing 12. Plate 14 also subdivides the chamber 20 into a particulate powder subchamber **20*a*, and an energized-gas subchamber 20*b*. Plate 16, at the exit end of chamber 20, contains thirty-one groups 22 of eight converging/diverging ejection nozzles 24 discharging into a same thirty-one counterbored cavities 26 formed in the outer surface of plate 16**.

Figure 4:
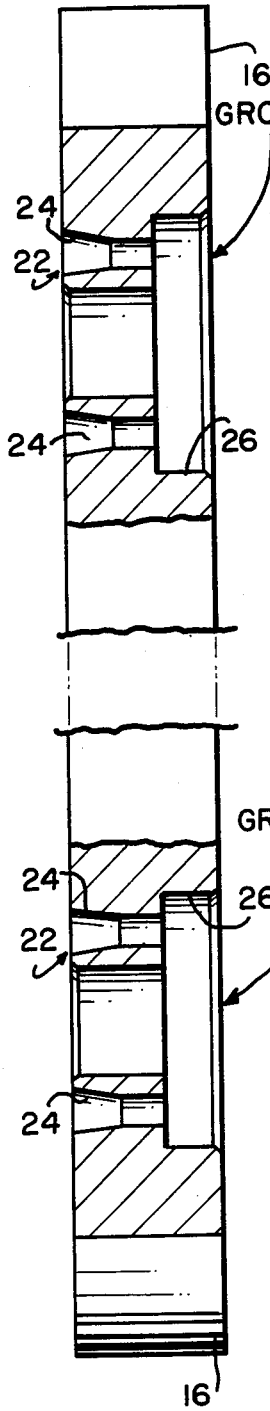
FIG. 4 is a cross-sectional view taken along section 4—4 of FIG. 3.
Figure 3:
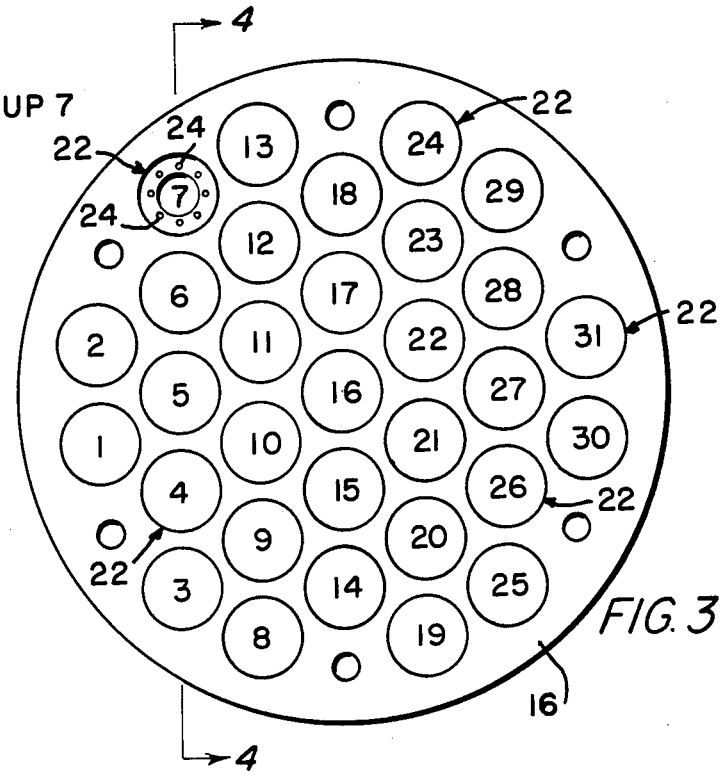
FIG. 3 is an elevational view of the nozzle plate, taken from the right-hand side of FIG. 4.

In FIG. 3, thirty of the groups 22 are shown simply and symbolically as circles; three depict the tubes 18 and the cavities 26. Only one group 22 is illustrated to show the eight nozzles 24 associated therewith. FIG. 4 shows a cross-section through two of the groups 22 with their nozzles 24. A plate 28 is fastened to the particulate powder entry end of the apparatus 10, and has a port 30 formed therein through which to admit the powder to the subchamber **20*a* and the tubes 18. Air from the bypass air supply of an auxiliary jet engine or from an engine-driven air compressor (such not being shown), at a pressure of approximately twenty to forty psig, and at a temperature of approximately three hundred to five hundred degrees Fahrenheit enters the subchamber 20*b* via the housing lower port 32. A further plate 34 containing thirty-one groups 36 of eight nozzle diffusers 38 serves as an exit end cover and is fastened against the ejection nozzle plate 16. FIG. 2 simply shows the diffuser groups 26 as circles. Too, it shows a central group 36, but for purposes of simplification it omits a showing of a tapped hole for the dispersion cone 40 shown in FIG. 1. In the ensuing text, the purpose of the cone 40** is explained.

Both end covers or plates 28 and 34 of the apparatus 10 are sealed by light press fits, and the diameters thereof are slightly larger than the diameter of the housing so that the cover plates 28 and 34 can be unbolted and tapped off for cleaning.

The groups 22 of ejection nozzles 24 are collinearly aligned with the groups 36 of diffusers 38. Too, each nozzle 24 is collinearly aligned with a diffuser 38, through an intervening void defined by the depth of the there-associated cavity 26.

Figure 6:
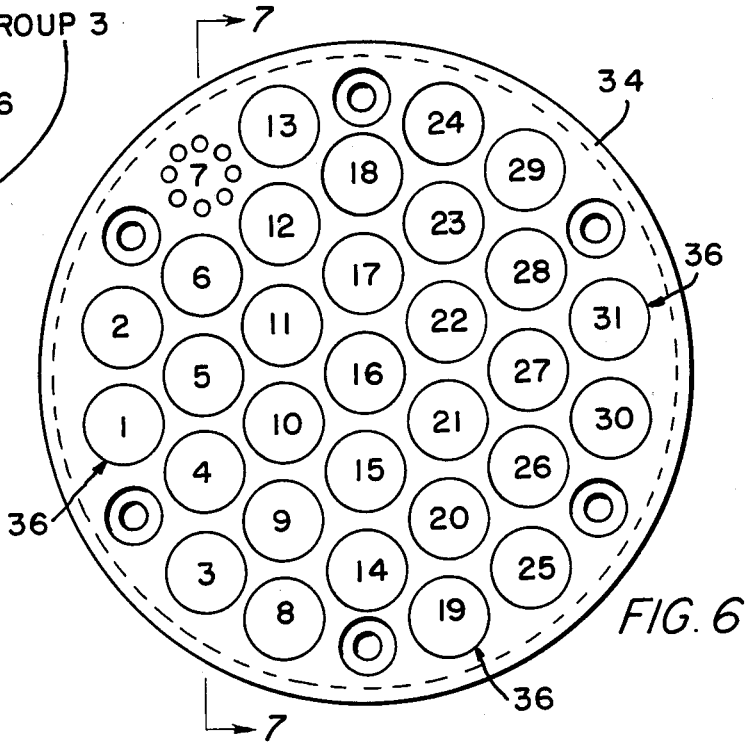
FIG. 6 is an elevational view of the diffuser plate, taken from the right-hand side of FIG. 7.

In FIG. 6, thirty of the diffuser groups 36 are shown only as circles, again. One group 36, however, does depict the cluster of eight diffusers 38. Also, Figure 7 shows a cross-section through two of the groups 36.

An important feature of our invention is the use of convergent/divergent ejection nozzles 24 which, depending upon the available static inlet pressure and temperature, create a higher supersonic velocity at the divergent exit of the nozzles. In addition to increasing the ejection capability, this higher velocity enhances the shearing action which breaks up the agglomerated particles of the powder into finer ones which will remain the airstream for longer periods of time and cover a larger area.

In order to obtain maximum suction and particle flow (where the particulate powder, for instance, is finely-divided brass) for a given throat size of ejection nozzles 24, and the afore-cited inlet temperature and pressure, certain dimensions are especially critical in the nozzle geometries. They are, in a preferred embodiment, for the aforesaid conditions:

1. Divergent ejection nozzle angle, $2\frac{1}{2}° \pm 0.1°$;
2. Divergent ejection nozzle exit diameter, 0.0725-inch;
3. Counterbore depth at divergent exit, 0.225-inch;
4. Diffuser entrance radius, $0.062 \pm 0.002$-inch;
5. Diffuser throat diameter, $0.140 \pm 0.001$-inch; and
6. Diffuser divergence angle, $5° \pm 0.1°$.

The apparatus 10 is intended to operate with little or no restriction in order to obtain maximum particle flow. In this embodiment, a two-inch NPS (Nominal Pipe Size) is provided for the particle inlet port 30 to insure free movement of the powder therethrough.

In this embodiment of the apparatus 10, the air-borne particle discharge is deflected at the exits of the diffusers 38 by a cone 40 which aids in dispersing the powder particles into wind currents. The cone 40 reduces the drawing-together of the individual nozzle/diffuser streams as a result of the air vacuum created between them by the discharge velocity. Of course, employment of the cone 40 closes off air and particle flow from the group 22 of nozzles 24 and the group 36 of diffusers 38 in the very center of the apparatus 10. The cylindrical stem of the cone 40, it will be recognized, blocks the exits of the there-sited eight diffusers 38.

The flow pattern, and the flow and suction capacity of the apparatus 10 is made variable by the use of "O" ring plugs 42 which can be inserted, as desired, between the nozzles 24 and the diffusers 38 of each group 22 and 36. The plugs 42 fit into the counterbored cavities 26 and block fluid communication between the arrays of eight nozzles 24 and eight diffusers 38 between which the plug(s) is/are interpositioned.

Another embodiment **10*a* of this invention is shown in FIG. 10, where same or similar index numbers signify same or similar elements as in FIGS. 1–9. An important purpose of this alternative embodiment is to counteract lateral vacuum forces in the gas/particle streams, which result in a concentration of particle flow. If particles are concentrated by this action, more premature fallout will occur, thereby mitigating the effect of the protective particle screen. In this embodiment 10*a*, the individual gas streams flow normally from the surface of a conical plate 34*a*. The ejection nozzles 24*a* and diffusers 38*a*** are arranged in an annular pattern. By this divergent geometry, the particles are more effectively introduced into the airstream.

While we have described our invention in connection with specific embodiments thereof, it is to be clearly understood that this is done only by way of example, and not as a limitation to the scope of our invention as set forth in the objects thereof and in the appended claims.

We claim:

1. Particulate dispersion apparatus, comprising:

a housing;

means for admitting both an energized gas, and particulate, into said housing;

means for discharging such housing-admitted gas, and dispersing such housing-admitted particulate, from said housing; wherein said gas discharging and particulate dispersing means comprises an array of ejector nozzles and an array of diffuser nozzles; wherein said ejector nozzles of said array thereof are each in collinear alignment along a given axis with one of said diffuser nozzles of said array thereof;

said ejector nozzles are of converging, diverging configuration;

each said ejector nozzle is spaced apart, along its given alignment axis, from the diffuser nozzle with which it is aligned;

said discharging and dispersing means further comprises means defining a cavity interposed between said array of ejector nozzles and said array of diffuser nozzles; and each of said nozzles has an end which opens onto said cavity.

2. A particulate dispersion apparatus, according to claim 1, wherein:

said housing has a chamber formed threwithin; and said admitting means comprises (a) ports formed in said housing and opening onto said chamber and, (b) conduit means, in traverse of said chamber, for openly communicating with one of said ports.

3. A particulate dispersion apparatus, according to claim 1, wherein:

said discharging means comprises a plate having said array of diffuser nozzles formed therein, and a plate having said array of ejector nozzles formed therein.

4. A particulate dispersion apparatus, according to claim 3, further including:

means fastening said plates together in interfacing contacting engagement; and wherein one of said plates has the aforesaid interposed cavity formed therein and defining a void between said plates.

5. A particulate dispersion apparatus, according to claim 4, wherein:

has a chamber formed therewithin; and said admitting means comprises (a) ports formed in said housing and opening into said chamber and, (b) conduit means in traverse of said chamber for openly communicating with one of said ports; and said conduit means further comprises means communicating said cavity with said one port.

6. A particulate dispersion apparatus, according to claim 2, further including:

subdividing said chamber into a plurality of subchambers; wherein one of said ports opens onto one of said subchambers and another of said ports opens onto another of said subchambers; and said conduit means comprises a plurality of tubes (a) in communication with one of said ports, and one of said subchambers, (b) supported in said subdividing means, and (c) in traverse of another of said subchambers.

7. A particulate dispersion apparatus, according to claim 6, wherein:

tubes of said plurality each further opens at an end thereof in immediate adjacency to a plurality of diffuser nozzles of said array thereof.

8. A particulate dispersion apparatus, according to claim 6, wherein:

each tube of said plurality has an exit end; and each exit end of each tube has a plurality of said ejector nozzles circumjacent thereto.

9. Particulate dispersion apparatus, according to claim 1, further including:

conical deflector means, coupled to said discharging and dispersing means, for aiding in dispersal of such housing-admitted particulate from said apparatus.

* * * * *